US011186423B2

(12) United States Patent
Heatley

(10) Patent No.: US 11,186,423 B2
(45) Date of Patent: Nov. 30, 2021

(54) LIQUID SPRAY SYSTEM

(71) Applicant: SEYMOUR OF SYCAMORE, INC., Sycamore, IL (US)

(72) Inventor: Christopher Heatley, McHenry, IL (US)

(73) Assignee: SEYMOUR OF SYCAMORE INC., Sycamore, IL (US)

( * ) Notice: Subject to any disclaimer, the term of this patent is extended or adjusted under 35 U.S.C. 154(b) by 0 days.

(21) Appl. No.: 17/205,258

(22) Filed: Mar. 18, 2021

(65) Prior Publication Data

US 2021/0292082 A1 Sep. 23, 2021

Related U.S. Application Data

(60) Provisional application No. 62/992,359, filed on Mar. 20, 2020.

(51) Int. Cl.

| | |
|---|---|
| ***B65D 83/66*** | (2006.01) |
| ***B65D 83/38*** | (2006.01) |
| ***B65D 83/20*** | (2006.01) |

(52) U.S. Cl.

CPC ..... *B65D 83/66* (2013.01); *B65D 83/205* (2013.01); *B65D 83/38* (2013.01)

(58) Field of Classification Search

CPC ..... B65D 83/66; B65D 83/205; B65D 83/38

USPC ..... 222/136, 399, 394, 402.1, 402.16; 141/98, 20, 21, 27, 113, 114

See application file for complete search history.

(56) References Cited

U.S. PATENT DOCUMENTS

| | | | | |
|---|---|---|---|---|
| 3,181,737 | A * | 5/1965 | Chaucer | B65D 83/42 222/136 |
| 3,632,045 | A * | 1/1972 | Oana | A62C 13/74 239/307 |
| 6,435,231 | B1 * | 8/2002 | Cooper | B65D 81/3211 141/107 |
| 6,883,564 | B2 * | 4/2005 | Risch | B65B 31/003 141/113 |
| 10,604,331 | B2 * | 3/2020 | Rose | B65D 83/425 |
| 2014/0102585 | A1 * | 4/2014 | Lasnier | B05B 11/0056 141/18 |

* cited by examiner

*Primary Examiner* — Lien M Ngo

(74) *Attorney, Agent, or Firm* — McDonnell Boehnen Hulbert & Berghoff LLP

(57) ABSTRACT

A spray system for dispensing a homogenous mixture of a liquid formulation and propellant as an atomized aerosol where a fill cup containing a liquid base is connected to a charge can to pressurize the inside of the fill cup and to act as a propellant. The charge can is attached to the fill cup through a fitting in fluid communication with the interior of the fill cup, where the fitting may be configured to allow the pressurized charge can to be detached after adding a propellant compatible with the liquid base to the fill cup. Preferably the liquid formulation is a paint base that can be tinted at the point of sale before charging with the charge can.

9 Claims, 4 Drawing Sheets

LIQUID SPRAY SYSTEM

CROSS REFERENCE TO RELATED APPLICATIONS

The present application claims priority to U.S. Provisional Patent Application No. 62/992,359 filed Mar. 20, 2020 which is herewith incorporated by reference into the present application.

TECHNICAL AREA

This disclosure relates to a system that allows for the preparation of a pressurized aerosol container of liquid, specifically a liquid paint formulation of a desired color and gloss, at the point of retail sale to the ultimate end user. Specifically, disclosed system allows for custom blending a final liquid formulation and charged with an appropriate propellant such that the final pressurized system can then be used to spray an atomized form of the liquid formulation directly on a substrate.

BACKGROUND

One of the most significant developments in the field of liquid applications, including paints and other protective coatings, is the introduction and development of aerosolized coatings, most commonly referred to as an "aerosol can" or "spray paint." Retail stores have shelf upon shelf of these pre-filled pressurized containers filled with all sorts of liquids, from bug spray to sun screen formulations. In particular, a significant amount of shelf space is devoted to numerous complete paint and coatings formulations, in every imaginable color and gloss that are "ready to use." These complete, pre-packaged spray paint containers provide the customer with a convenient means to purchase moderate quantities of paint in a readily useable spray container for easy application. Unfortunately, in situations where the end user only wants a small quantity of liquid or perhaps a custom blend of liquid ingredients or has a particular color in mind or wants to match a particular existing color, the current art of aerosols or spray paint forces the end user to accept only what is available or to select a paint color that in most cases is not the exact color that the user desires. This is because there is no convenient means to allow a consumer to prepare a custom liquid formulation for spraying or to select an exact match of color at the point of aerosol purchase. Instead, in the case of paint applications, the user must search a myriad of brands of spray paint in the hope of finding a color that at least comes close to the desired color. Often times, this causes the end user to travel from store to store in search of such a match. Another drawback of the conventional spray paint product is that the inability to prepare a final paint color at the point of sale directly affects the retailer. Because conventional spray paint is only available from the manufacturer in pre-selected and predetermined colors and gloss, the retailer is forced to stock and carry inventory for a large number of cans to accommodate a large number of colors and gloss finishes. This further requires the use of an inordinate amount of shelf space in the store, thus limiting the amount of other products that can be displayed.

A convenient solution to the above-mentioned problems would be to allow the retail outlet at the point of sale to prepare custom liquid formulations while the customer waits or to formulate a final color of an aerosol spray paint based on the end user's selections of color and gloss at the moment of sale. In this way, only a very limited number of containers with base liquids or containers with either a clear or neutral base paint formulation need to be stocked and shelved by the retailer. The end user can then have a custom blend with a particular liquid formulation prepared or in the case of paint, select a final paint formulation that exactly matches his or her needs. The art has recognized one possible solution to the above-mentioned problems, namely in U.S. Pat. Nos. 7,201,191 and 7,252,119. However, there exists the problem, once the final liquid formulation is chosen and added to a container, of injecting or adding an appropriate propellant that is needed to create an atomized spray of the liquid for application to a substrate. Likewise, U.S. Pat. No. 8,978,935 provides a possible solution where a disposable charge can is used to pressurize a container that contains an amount of a liquid formulation.

The present disclosure now provides a new and improved liquid spray system that includes a disposable charge can that is used to add a propellant and other compounds to a base liquid contained in a fill cup fabricated of low-cost materials, such as, plastic, tin, or aluminum and having robust connectors for both the charge can connection and fill cup sealing.

SUMMARY

The present disclosure includes systems and methods for preparing such systems for spraying/atomizing liquid formations, specifically paint formulations and the like materials. Preferably, these systems are used by an employee of a retail store at a point-of-sale location to prepare a pressurized custom spray formulation for a purchasing consumer that can be immediately used by the customer to apply the formulation to a substrate.

The spray system of this disclosure can take on a number of different configurations. Common attributes of each of the different configurations of the embodiments of this disclosure include, in combination, a disposable or reusable low-cost container, i.e., a fill cup, having an inlet valve, a sealing cap configured for secure fitting to the fill cup after a liquid formulation is added, and a pressurized charge container that is designed to attach to the inlet valve fitting in the bottom of the fill cup in order to pressurize the fill cup. It is preferred that the inlet fitting is constructed of a robust material such as metal, preferably brass. Further, the inlet fitting preferably is a threaded connection, e.g., female threads, that will form a pressure seal connection with the outlet fitting of the charge can. The inlet fitting can also contain a one-way valve or check valve that only allows fluid flow from the pressurized charge container into the fill cup, i.e., the check valve will prevent fluid flow from the interior cavity of the fill cup into the pressurized container.

In one particular system there is a fill cup configured as a disposable container fabricated of low-cost material, such as plastic, tin, aluminum or other like materials, having an upper end and an interior cavity with a volume for holding a liquid formulation. It is preferred that the fill cup must be constructed and configured to withstand internal pressurization of greater than 0 psig or withstand at least about 80 psig. A sealing cap, preferably constructed of plastic, can be removably or permanently fastened to the upper end of the fill cup, where the fastener or connection is configured to seal the valve assembly within the container to maintain pressure within the fill cup after being charged with propellent.

The system also includes a valve assembly configured for attachment to an upper opening of the sealing cap. The valve assembly is preferably crimped onto the opening to sealably connect the valve assembly to the fill cup such that the disposable or reusable container can be pressurized without losing pressure at the connection between the opening and the valve assembly. The valve assembly can include a fitting, a crimpable flange and a dip tube that is of a sufficient length that it extends down into the fill cup volume when the valve assembly is attached to the opening. As stated, the valve assembly can be held in a sealing connection with the opening in the upper end of the fill cup through the use of a flange that is crimped in place to the opening, or through a permanent snap fitting, screw fitting, or any other connection that will result in a pressure seal. Once in place the opening and valve assembly form a pressure seal such that when the fill cup is charged with pressurized fluid or propellent the pressure seal will not leak and pressure will be maintained within the interior cavity of the fill cup.

The system of the present disclosure also includes a pressurized charge can that has an outlet fitting that mates with a corresponding inlet fitting located on the bottom of the disposable or reusable container or fill cup. The inlet and outlet fittings may be configured as proprietary fittings, meaning that that fittings are not of a common or standard design, similar to a unique key and lock system. In other words, the male portion of the fitting will only fit into a like configured female fitting. This can be accomplished a number of ways including non-standard thread design, non-standard luer-lok, non-standard quick disconnects, and non-standard releasable snap locks to name a few. Using proprietary fittings prevents attachment of non-approved pressure sources and thus prevents accidental over pressurization. The charge can is used to pressurize and transfer a propellant to the fill cup. The charge can also transfer other ingredients to the interior volume of the fill cup, such as pigments, catalyst, stabilizers, or other fluid materials.

In one possible embodiment of the present disclosure, there is presented a spray system for liquids having, in combination, a nozzle (e.g., a spray head), a valve assembly configured to accept the nozzle, where the valve assembly has a connector, a sealing cap having a top opening configured for accepting the connector to form a sealed connection, where the cap has a lower opening and a disposable or reusable container (e.g., a fill cup) having an upper end configured to form a form a removable connection to the lower opening of the cap, where the fill cup has a lower end and an interior cavity, where the lower end has an inlet fitting that is in fluid communication with the interior cavity and where the fill cup is constructed of a material such that the interior cavity can withstand an internal pressure greater than 0 psig when the upper end is sealed to the cap and the valve assembly is secured to the top opening of the cap. Preferably, a seal, configured as a separate or integral component of the cap or fill cup, is positioned between the lower opening of the cap and the upper end. The system also contains a pressurized charge can having an outlet fitting that is configured to cooperate and engage with the inlet fitting to allow fluid flow from the charge can into the interior cavity of the fill cup, where the charge can contains pressurized propellant. The charge can have a first disconnected state where it is a separate and non-connected component, and a second state, where the charge can and the fill cup are connected through the inlet fitting and the propellent originally in the charge can has transferred to the interior of the fill cup.

The lower end of the fill cup preferably is designed and constructed with support side walls terminating in a bearing surface that will engage and abut an upper edge of the charge can when the charge can is in the second state. A convenient shape of the support side walls defines a circular opening or coupling with the bearing surface being the terminal end of the circular opening. The interior defined by the support side walls is configured to accept the top portion of the charge can which contains the outlet fitting that connects to the inlet fitting of the fill cup. The support side walls are of a length such that when the outlet and inlet fittings are connected such that the propellent can transfer to the fill cup, the bearing surface is in tight engagement with the upper edge of the charge can such that the charge acts a support for the fill cup and also function as a hand support for the user when spraying the pressurized liquid formulation through the nozzle.

The valve assembly connector can be one where a crimp fit is used to form a pressure seal between the valve assembly and the top opening in the sealing cap. This crimped connection is configured such that the actual crimping and resultant pressure seal attachment can be achieved at a point of retail sale or alternatively can be formed by a manufacturer prior to supplying the presently described paint system to a retail store location.

In a preferred embodiment, a user of the present system will add to the volume or interior cavity of the fill cup a paint base selected from the group consisting of a solvent base, a waterborne base and a latex base. A tint and/or pigment dispersion can be added to the paint base to achieve a final desired color. Alternatively, a complete tinted liquid formulation can be added to the cavity. In addition to the pressurized gas and propellant, the charge can may also contain a paint catalyst that accelerates the drying of the paint or otherwise improves the paint formulation. In the case of epoxies, the catalyst initiates the chemical reaction that hardens the epoxy formulation. After charging is complete, the charge can is removed and can be disposed of or reused depending on the original ingredients in the charge can. The charge can is preferably designed to attach permanently to the fill cup and, as such, is configured for a single use and then is either disposed of or reprocessed, i.e., recycled and/or refilled with a pressurized propellant and/or catalyst. Prior to use by the end user or purchaser of the spray system, a spray head is attached to the fitting on the valve assembly. One unique aspect of the present disclosure is that the charge can is designed and configured to be charged at a pressure greater than 80 psig, preferably greater than 100 pig so that when it is connected to the interior volume of the fill cup, a complete transfer of all the propellant, other ingredients and/or catalyst is effected and the fill cup will then be pressurized to substantially the same pressure as the initial internal pressure of the pressurized can, which preferably is at least 80 psig or greater. Further, pressurization using the charge can is performed as a single step and the charge can is either removed from or left connected to the system, but in any event no longer used or relied on again to supply pressurized propellent to the fill cup. In a preferred design the fill cup has a check valve incorporated in the inlet fitting that is positioned at the bottom of the fill cup so that when the pressurized can is connected to the inlet fitting the pressurized fluid transfers directly through the one-way check valve into the interior cavity of the fill cup thus increasing the pressure of the interior cavity and simultaneously reducing the starting pressure inside the pressurized can. The check valve will prevent pressure equalization between the interior cavity and the inside of the pressurized can ensuring that the fill cup interior will be at a greater pressure that than the inside of the pressurized can.

Although some of the embodiments of the present invention are described herein as preparing pressurized spray paint containers at the point of retail sale for use by a purchasing customer, the system can be used to prepare any pressurized spray container containing liquids other than paint, for example, air fresheners, cleaners, polishes, insecticides, adhesives, epoxies, lacquers, repellants, lubricants, sunscreens, and like pressurized spray products sold to consumers at retail stores. For clarity and ease of understanding the following description will relate to preparing a "spray paint" container.

In one possible use of the system of this disclosure, a customer selects his or her desired end product color from a color chart or by matching an existing color from a sample. Next, the retail store employee determines a recipe of tints and other components to add to the fill cup that already contains a base paint formulation (i.e., one selected from the group consisting of a solvent base, a waterborne base and a latex base) such that a final paint formulation (or other liquid formation if the end product is not a spray paint product) results when dispensed as a spray from the complete system will result in a spray paint product that matches the color and gloss requested by the customer.

The connection between the fitting on the inlet fitting and the charge (pressurized) can is preferably metal screw thread that ensures a fluid seal to allow transfer of the contents of the charge can into the fill cup. Preferably, the connection is a proprietary connection between the inlet fitting and charge can such that no other manufacturer's products will connect with the fill cup. This prevents the retail store employee from using the wrong or improper charge can to pressurize the fill cup. Likewise, having proprietary keyed fittings prevents the retail employee from charging (transferring) the wrong propellant (or pressurized fluid mixture) into a non-compatible pre-existing liquid formulation supplied in the fill cup. To achieve this keyed connection between the fittings on the inlet fitting and the pressurized can, the respective fittings or connectors should have matching connectors, such as grooves, slots, splines, thread pitch, bayonet fittings, or the like keyed features that work similar to how a key and lock combination works to provide a matching connection.

The fill cups of the present disclosure preferably are supplied by a manufacturer to the retail store containing a base paint formulation as a so-called "blank" containers. (i.e., pre-filled fill cups containing an initial or base paint formulation, but without color and at atmospheric pressure). The fill cups can be provided in sizes of 8 oz., 16 oz., and 20 oz. These blank containers can be made available by a manufacturer containing a number of different initial liquid formulations that are compatible with different propellants contained in the charge cans. In the case of preparing a finished spray paint product, the fill cup comprises an initial paint formulation comprising at least one of a clear or neutral non-pigmented base or clear or neutral pigmented base. These base paints can be water soluble, latex, or hydrocarbon solvent based.

The pre-filled fill cups can then be shipped and stocked at a retail store utilizing only a fraction of the space needed for conventional spray paint products. Immediately prior to the sale, the ultimate end use or customer selects a final color and gloss level to complete the final paint formulation. A recipe or look up table is used by the store employee to determine the exact volumetric or weighed amounts of tints and/or pigment dispersions that are needed to be added to the fill cup through opening at the upper end of container to achieve the desired final color. These tints and/or pigment dispersions can be added individually to the interior volume of the fill cup or preferably as a single cocktail or formulation. Whether one ingredient or several ingredients are added individually or as a mix, the additives for the purposes of this disclosure are considered a liquid formulation or a paint formulation.

Typically, the final color desired is based on a matching of an existing color or type of paint previously purchased by the user. The end user will select a final color for the aerosol container by one of several methods. The user may manually reference a color wheel, paint swatches, or paint chips to select a final color and will also select or request a preferred gloss level. For each color that can be selected there will be a corresponding predetermined formula or recipe of tints and/or pigmented dispersions that when followed and the ingredients mixed with one of the three possible initial paint formulations will yield the final desired color.

Alternatively, the user may want to match an existing color based on a sample of a color that they would bring with them to the point of sale. This is performed simply by comparing the known color provided by the user to a color wheel or to paint swatches, or by using a spectrophotometer or other automated system to match colors. Typically, such an automated procedure involves providing a sample of a known color for analysis by a spectrometer whereby the exact sample color is determined and reported to either the end user or the retail store operator or directly to a computer controlled filling machine.

Once the final sample color is determined and a formula of additives is determined, the ingredients according to the formula are mixed together (or added separately) and added into the fill cup. Additionally, flattening dispersions may be added to achieve the desired gloss level, which is typically determined using gloss meter, preferably at a 60° angle. Flattening dispersions are added to modify the gloss level to the desired finish. Once all ingredients necessary to achieve the final liquid formulation are added to the fill cup, the valve assembly can be added to the upper portion of the container.

At this point in the process of preparing the paint system of the present disclosure the valve assembly is now attached to the sealing cap before the sealing cap is connected to the opening in the upper end of the fill cup or, alternatively, after the sealing cap is connect to the opening. The upper end opening can have a protective cap that is removed and discarded immediately before adding the final ingredients to the base formulation. This protective cap can be attached at the point of manufacture of the pre-filled fill cup and provides a seal during shipment to a retail store location and during shelf life. After the valve assembly has been inserted with the flange positioned in a sealing fashion on the opening in the upper end of the fill cup, the sealing cap can then be connected, preferably via screw threads.

Once the sealing cap is in place along with the valve assembly on the fill cup, a charge can containing a compatible propellant and pressurized gas is connected to the inlet fitting. Once connected, the pressure in the charge can (preferably at least 100 psig or more) flows through a one-way check valve in inlet fitting such that the propellant, and any other ingredients, such as a catalyst, is automatically driven into the interior volume of the fill cup. In the former embodiment, the fitting is in fluid communication with dip tube that is part of the valve assembly. The contents that were in the charge can are now intimately and homogenously mixed with the liquid formulation originally present in the fill cup. Once the charge can contents are transferred, the charge can remains attached to the fill cup to provide a base for the fill cup and a convenient surface for the user to hold during use of the finished spray system. In some embodiments, the now empty charge can be disconnected from the bottom of the fill cup and then discarded, or possibly re-charged with pressurized propellent for use with another fill cup. A pressure gauge connected to the charge can visually indicate to the user that contents have transferred, as evidenced by a drop in can pressure. As indicated, one or more check valves can be used to ensure that the contents only transfer one way, i.e., from the charge can to the interior of the fill cup.

Once the charge can is disconnected from the inlet fitting of the fill cup, a spray head can be connected to the valve assembly fitting. The system is now ready for use in a manner that is basically the same as for well-known conventional spray paint cans. Once the user is finished applying the liquid as a spray to a substrate or as an aerosol mist for order control or insect repellant, the entire system can be discarded.

Advantages of present system include, but are not limited to, allowing the retail consumer to purchase the exact color of their choice, and not to have to accept a color that just happens to be stocked by the retailer. Consumers can also select the exact gloss desired. The present system is applicable to 2K paint systems and can be used for epoxies, gel coats, acrylics, and urethanes.

Still further advantages of the present disclosure will become apparent upon reading and understanding the following detailed description of preferred embodiments. The various possible embodiments of the present disclosure also may take form in various parts and arrangement of parts. These and other aspects of, and advantages with, the present disclosures will become apparent from the following detailed description of the present disclosure and from the accompanying drawings. The accompanying drawings are only for purposes of illustrating preferred embodiments and are not to be construed as limiting the present disclosure.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DETAILED DESCRIPTION

The spray system of the present invention allows any type of homogenously mixed liquid formulation to be discharged in atomized spray pattern onto a substrate or merely into the atmosphere in the case of an air freshener or bug spray. Preferably, the liquid would be a paint mixture, either a solvent based, water based or latex based paint mixture. FIGS. 1-6 show a preferred embodiment of the present disclosure.

Figure 1:
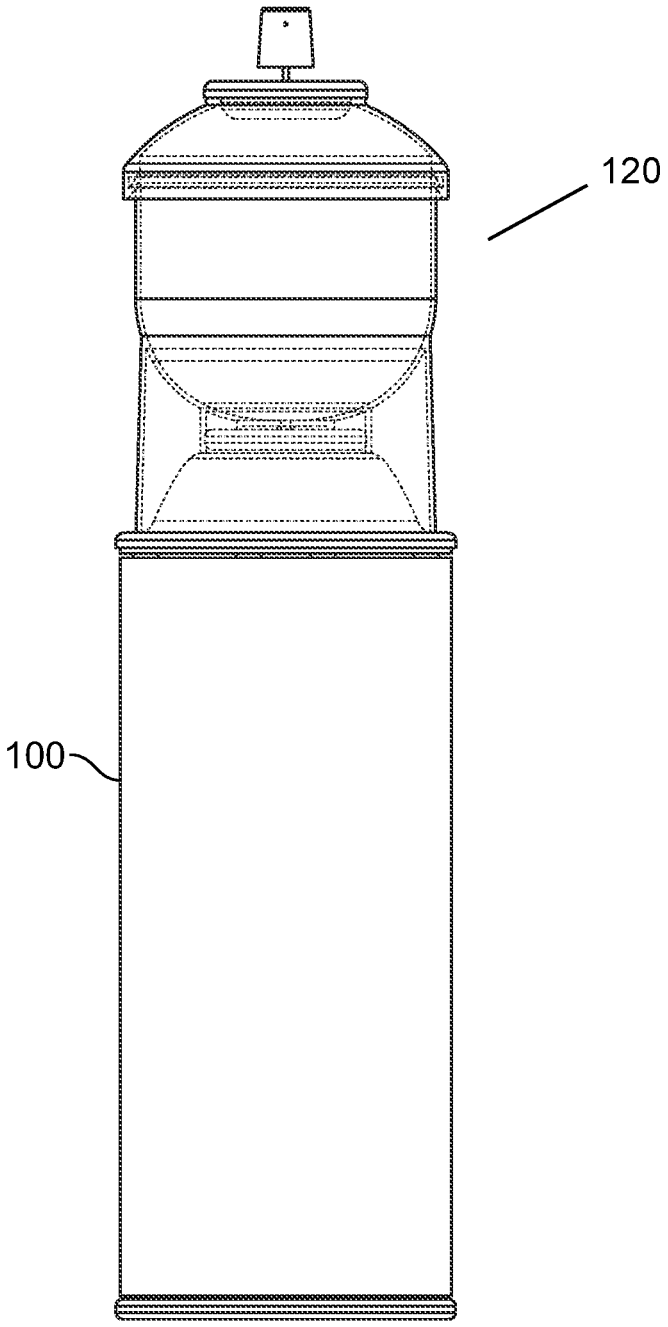
FIG. 1 is a schematic representation of one configuration of the complete spray system of the present disclosure.
Figure 2:
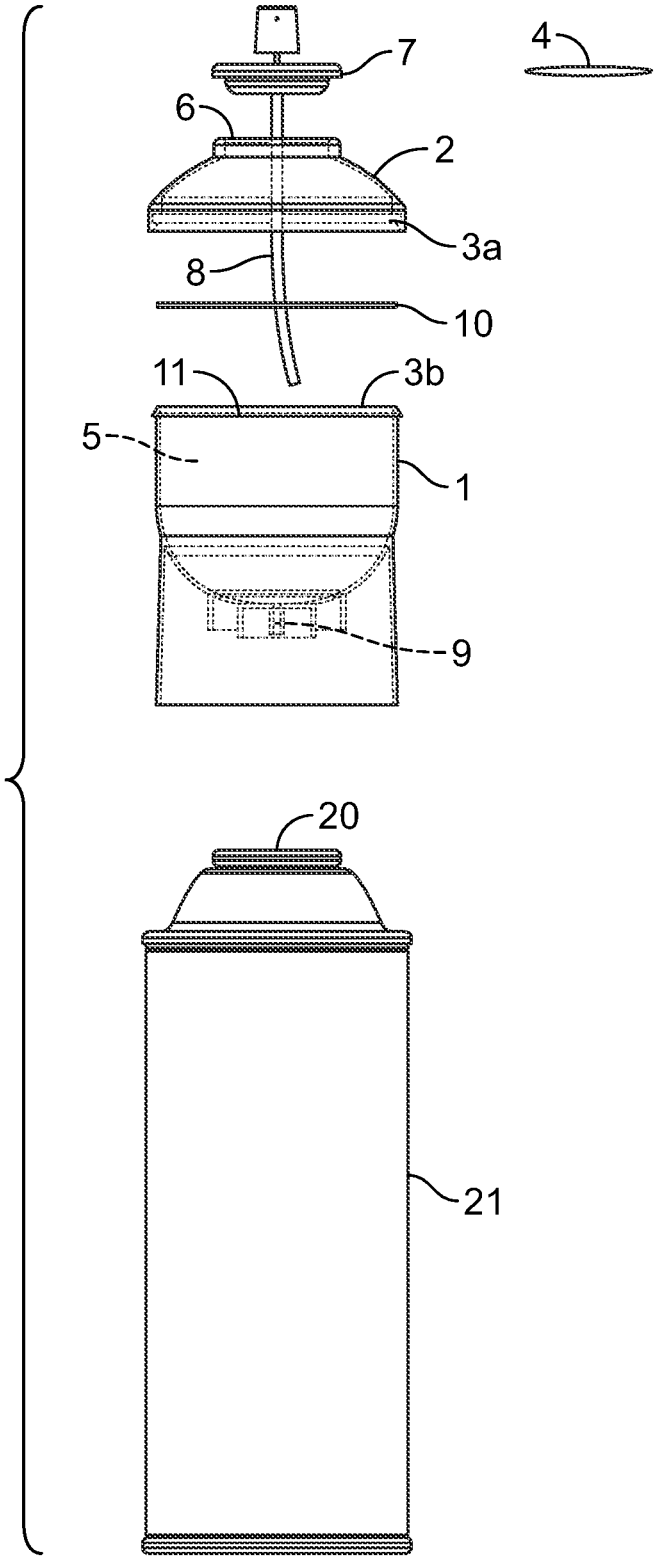
FIG. 2 is a disassembled view of the spray system of FIG. 1.

Turning to FIG. 1 there is shown one embodiment of the complete spray system 100 of the present disclosure having a fill cup (disposable or reusable) 1 that has an interior volume or cavity 5 (see FIG. 2). This container can be manufactured from any known polymer material, preferably a plastic composition that is biodegradable. Likewise, the fill cup can be fabricated from low-cost materials such as tin, aluminum or like materials, especially in the case where the fill cup is designed as a disposable, non-reusable container. Regardless of the material of construction, it is essential that the fill cup can withstand internal pressurization of about 100 psig, and at least 80 psig. The volume 5 should be at least capable of holding greater than 2 oz. of liquid, most preferably greater than 5 oz. of liquid. At the upper end of fill cup 1 there is a connector, shown as screw thread 3*b* in the particular embodiment illustrated in FIG. 2, however, any type of connector can be used provided that it can mate with a like connector 3*a* on sealing cap 2. The connectors 3*a*, 3*b* must be capable of sealing the fill cup 1 with cap 2 such that it can maintain an internal pressure in volume 5 of at least 50-80 psig, most preferably greater than 100 psig.

Cap 2 can be made of any material that allows it to connect and maintain a pressure seal with container 1. Preferably, cap 2 is made of the same disposable material as used to fabricate container 1. Cap 2 has an orifice or opening 6 that is generally centered in the top of the cap and is configured to accept and/or allow attachment of a valve assembly 7 (see FIG. 2). A protective, removable small cap 4 is configured to temporarily cover and protect opening 6 until the valve assembly 7 is ready to be installed/connected to sealing cap 2 of container 1. The bottom of container 1 may also have an inlet fitting 9 that provides for fluid communication with the interior cavity of container 1. The inlet fitting 9 is configured as a separate component that is attached to the bottom of the fill cup 1 so as to allow fitting 9 to be accessed for attachment of a pressure source, such as the charge (pressurized) can 21 as illustrated in FIG. 1. Fitting 9 can also have a one-way check valve 9*a* allowing fluid flow only into, and not out of, the cavity 5.

Figure 4:
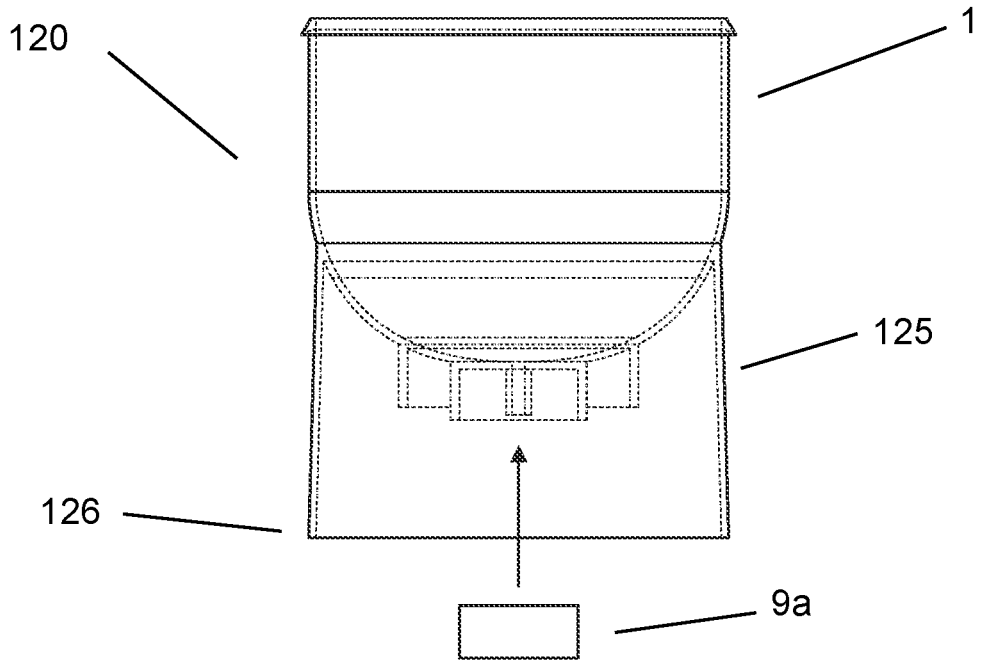
FIG. 4 is a disassembled view of a second subassembly of the spray system of FIG. 1 where the fill cup (disposable container) is formed from an injection molding process where the inlet fitting has yet to be attached to the bottom of the fill cup cap.

FIG. 4 shows support side walls 125 that can be of a length such that when the outlet and inlet fittings are connected such that the propellent can transfer to the fill cup 1, the bearing surface 126 is in tight engagement with the upper edge of the charge can such that the charge acts a support for the fill cup and also function as a hand support for the user when spraying the pressurized liquid formulation through the nozzle.

Figure 5:
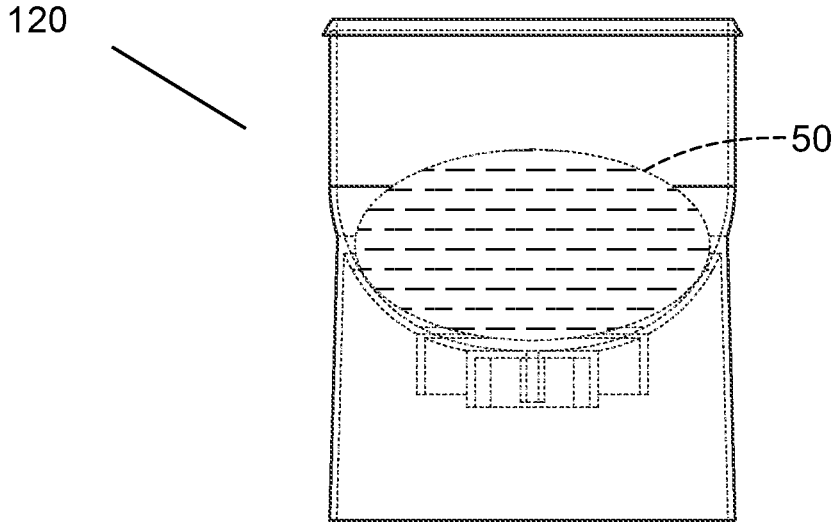
FIG. 5 is a schematic representation of the fill cup of FIG. 4 where a liquid formulation has been added to the interior cavity and a metal inlet fitting has been secured to the bottom of the fill cup.

Container 1 can contain any liquid 50 that can be sprayed/atomized (see FIG. 5). Preferably, the container is pre-filled at a manufacturing location with a paint base selected from the group comprising a water soluble, solvent based, or latex paint base. The container could also be filled at the point of sale by a retailer after selection of the liquid by the consumer. In the case of a paint base, the addition of tints or other coloring or paint enhancement compounds could be added to the paint base before final assembly and pressurization of the spray system of my invention.

Figure 3:
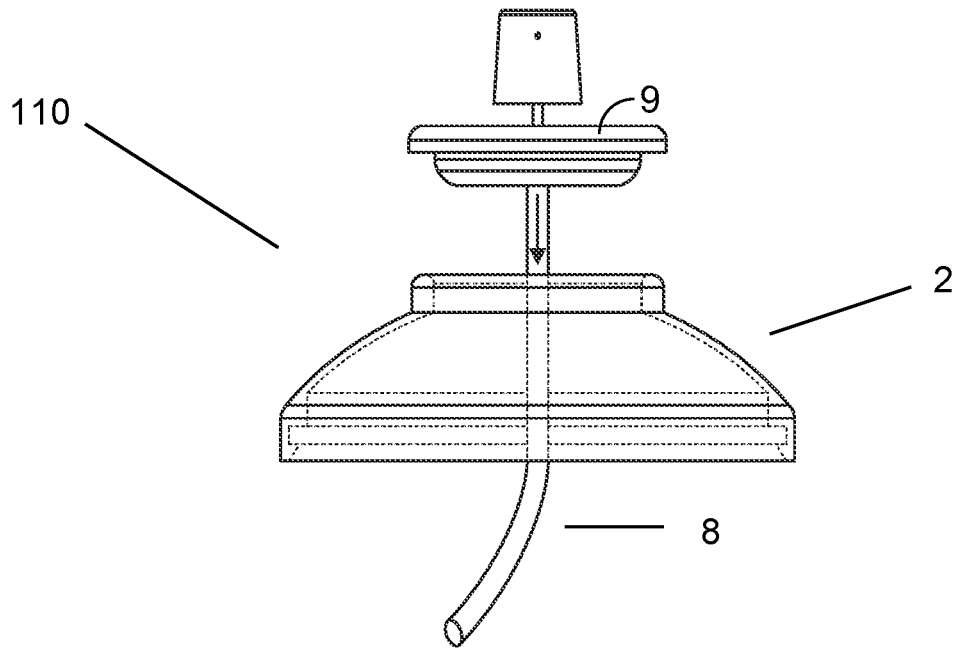
FIG. 3 is a disassembled view of a first subassembly of the sealing cap and valve assembly of the spray system of FIG. 1.

As illustrated in FIGS. 2 & 3, valve assembly 7 comprises a dip tube 8, and a pressure seal 10. In one possible use of the spray system, the cap 2 fixedly attached to the fill cup 1, with small protective cap 4 in place on the top opening 6, is removed from the upper end 11 of the fill cup 1 and an additional liquid that is to be sprayed/atomized is placed into volume 5, which preferably already contains a base paint formulation when it was manufactured and shipped from the supplier to the retail store. Alternatively, the sealing cap 2 and fill cup 1 can remain securely connected through connectors 3*a*, 3*b* and instead protective cap 4 is removed and discarded, and the additional liquid is added to cavity 5 through the top opening 6.

Once the additional liquids or in some cases powders are added to the volume (cavity) 5, then either sealing cap 2 is attached through connectors 3*a*, 3*b* forming a pressure seal or in the latter possible embodiment, the valve assembly 7 is secured to top opening 6. In some circumstances it may be desirable to add solid mixing elements, such as metal or plastic balls, to aid in mixing the contents of the cavity after the fill cup is sealed shut and pressurized. The liquid filled fill cup 1 is now ready for connection to the charge can 21.

Charge can 21 has an exit or outlet fitting 20 that may mate/connect directly to inlet fitting 9 located at the lower part of the fill cup 1. Any type of fittings can be used provided the type selected allows for transfer of a pressurized fluid between the charge can 21 and the interior volume 5 of the fill cup 1 through inlet fitting 9. In a preferred embodiment the fittings are selected so that they are specifically keyed to each other and will not attach/connect to another manufacturer's fitting. In this way the charge can from one manufacturer/supplier cannot be inadvertently connected/attached to the inlet fitting 9 from the manufacturer/supplier of the fill cup 1.

The charge can 21 can be pre-filled by a manufacturer with a specific type of propellant that is compatible with the specific type of liquid contained in the fill cup 1. The charge can is pressurized to above 50 psig, preferably above 100 psig, by introducing compressed air, nitrogen, carbon dioxide, or other relatively inert gas or mixtures of gases. Charging of the charge can 21 with pressure and a propellant could be performed by the manufacturer of the charge can or also be performed at a retail point-of-sale location. For example, if the liquid in a 10 oz. fill cup 1 was a solvent based paint base, then approximately 2.5 oz. of dimethyl ether propellant could be added (charged) to the charge and then pressurized to 100 psig with compressed air. In addition to the propellant and pressurized gas, other ingredients could be added, such as a catalyst formulation that allows, for example, quick drying of a sprayed paint mixture. Such catalyst formulations could include any component which accelerates a chemical reaction between two or more other components, for example metal salts and poly-isocyanate resins. These catalysts can accelerate drying of the final spray product and/or cause a reaction to start as in the case of an epoxy. Other compounds could be added to the charge can, such a gloss formulations, polyesters, gel coats, acrylics, and polyurethane. Paint types include acrylic lacquer, acrylic enamel, acrylic urethane and water-based, more simply referred to as lacquers, enamels, urethanes and water-based.

With the final formulation of liquid now inside volume 5 of the fill cup 1, the charge can 21 is connected to inlet fitting 9 of the fill cup 1 (see FIG. 1). Because the pressure in the charge can is much greater than the atmospheric pressure, i.e., 0 psig, of volume 5, the contents of charge can 21 is driven or forced into volume 5 to mix with the liquid initially present. This forms a homogeneous mixture. The transfer can be automatic upon connection of the fittings or alternatively, there could be an optional valve (not shown) to activate after the fittings are connected. In either case the transfer of the components in charge can 21 is very fast. Optionally, a pressure gauge (not shown) could be associated with the charge can and one or more check valves such that the user could visibly observe that the transfer is or has occurred.

After transfer of the contents of the charge can 21 into fill cup 1, the charge can may remain connected to the fill cup or the charge can be disconnected from the inlet fitting, removed from the system, and then discarded for disposal or for re-charging and re-use with another system. A spray head 25 can then be attached to valve fitting 7 (see FIG. 6) and the system is now ready for use. Aerosol spray heads are well known, and the presently disclosed system is easily adapted to accept known designs.

Figure 6:
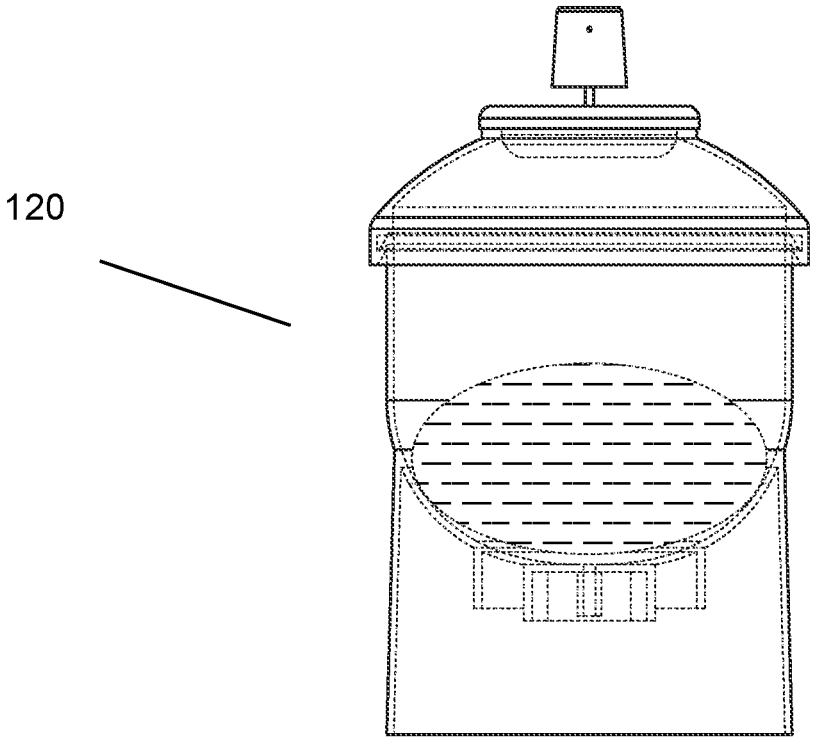
FIG. 6 is a schematic representation of the fill cup of FIG. 5 where the sealing cap and valve assembly have been attached to the top portion of the fill cup to created a sealed interior cavity.

FIG. 3 shows one possible configuration for a manufacturing cap subassembly 110 and FIGS. 4-6 shows different manufacturing stages of a fill cup subassembly 120.

The present disclosure has been described with reference to a preferred embodiment. Obviously, modifications and alterations will occur to others upon reading and understanding the preceding specification. It is intended that the embodiments of the present disclosure be construed as including all such alterations and modifications insofar as they come within the scope of the appended claims or the equivalents thereof.

The invention claimed is:

1. A spray system for liquids comprising, in combination, a nozzle;

a valve assembly comprising a dip tube that is in fluid communication with the nozzle, where the valve assembly has a crimpable connector located below the nozzle;

a cap comprising a top opening configured for accepting the crimpable connector to form a crimped sealed connection, where the cap has lower opening opposite the top opening;

a disposable container comprising an upper end configured for removable connection to the lower opening, where the disposable container has a lower end and an interior cavity, where the lower end has an inlet fitting that is in fluid communication with the interior cavity and where the disposable container is constructed of a material such that the interior cavity can withstand an internal pressure greater than 0 psig when the upper end connected to and is sealed to the lower opening of the cap;

a seal positioned between the lower opening and the upper end such that when the cap is releasably connected to the disposable container a pressure seal is created between the disposable container and the cap; and a charge can comprising an inside portion that is pressurized with a propellant to greater than atmospheric pressure when in a first disconnected state, where the charge can further comprises an outlet fitting that is configured to cooperate and engage with the inlet fitting when in a second connected state such that the pressurized propellant will flow from the charge can into the interior cavity of the disposable container, wherein the inlet fitting further comprises a check valve and metal screw threads that are engaged with the outlet fitting when the charge can is in the second connected state such that a hand support is formed for a user of the spray system when operating the spray system.

2. The spray system of claim 1, wherein the inlet fitting and the outlet fitting form a permanent and non-removable connection when the charge can is in the second connected state.

3. The spray system of claim 1, wherein the lower end of the disposable container comprises a support side wall that terminates in a bearing surface that cooperates with an outer portion of the charge can when the charge can is in the second connected state, wherein the side wall forms part of the hand support.

4. The spray system of claim 1, wherein the connector is crimped fitted to the top opening to form a permanent and non-removable connection between the cap and the connector.

5. The spray system of claim 1, wherein the inlet fitting and outlet fitting are keyed fittings such that inlet fitting can only connect to a correspondingly configured outlet fitting.

6. The spray system of claim 1, wherein inlet fitting is a female configured fitting allowing fluid flow only into the interior cavity.

7. The spray system of claim 1, wherein the interior cavity of the disposable container is configured to hold a pressurized fluid at about 80 to about 100 psig and the inside portion of the charge can when in the first disconnected state is at a pressure greater than 80 psig.

8. The spray system of claim 1, wherein the interior portion of the charge can is configured to hold a pressurized fluid at about 80 to about 100 psig.

9. The spray system of claim 1, wherein the charge can contains a propellant and a catalyst.

* * * * *